US010369829B2

(12) United States Patent
Obuchi et al.

(10) Patent No.: US 10,369,829 B2
(45) Date of Patent: Aug. 6, 2019

(54) SHEET PROCESSING APPARATUS AND IMAGE FORMING APPARATUS

(71) Applicant: CANON KABUSHIKI KAISHA, Tokyo (JP)

(72) Inventors: Yusuke Obuchi, Nagareyama (JP); Hideto Abe, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/867,944

(22) Filed: Jan. 11, 2018

(65) Prior Publication Data

US 2018/0134061 A1 May 17, 2018

Related U.S. Application Data

(63) Continuation of application No. 15/068,850, filed on Mar. 14, 2016, now Pat. No. 9,902,183, which is a (Continued)

(30) Foreign Application Priority Data

Dec. 10, 2012 (JP) ..... 2012-269205

(51) Int. Cl.
*B42B 5/00* (2006.01)
*B31F 5/02* (2006.01)
(Continued)

(52) U.S. Cl.
CPC ..... *B42B 5/00* (2013.01); *B31F 5/02* (2013.01); *B42B 4/00* (2013.01); *B42C 5/00* (2013.01);
(Continued)

(58) Field of Classification Search
CPC ..... B42B 5/00; B31F 5/02; B31F 1/07; B31F 2201/0712; B65H 2301/51616; B42F 3/003; G03G 2215/00852
(Continued)

(56) References Cited

U.S. PATENT DOCUMENTS 5,602,651 A 2/1997 Tabata et al.
5,717,843 A 2/1998 Tabata et al.
(Continued)

FOREIGN PATENT DOCUMENTS

JP 07-89256 A 4/1995
JP 2010-189101 A 9/2010
(Continued)

OTHER PUBLICATIONS

Office Action dated Apr. 28, 2015, in Japanese Patent Application No. 2012-269205.
(Continued)

*Primary Examiner* — Leslie A Nicholson, III
(74) *Attorney, Agent, or Firm* — Venable LLP

(57) ABSTRACT

A staple-less binding unit including a pair of upper and lower teeth binds a sheet bundle which is discharged to an intermediate processing tray by a sheet discharge portion and whose one edge abuts against a rear edge stopper. A control portion switches a binding mode of the staple-less binding unit that implements the binding process on the sheet bundle in a first binding mode of binding the sheet bundle without any staple such that the pair of upper and lower teeth bite across an edge of the sheet bundle and in a second binding mode of binding the sheet bundle without any staple such that the pair of upper and lower teeth do not bite across any edge of the sheet bundle.

15 Claims, 16 Drawing Sheets

Related U.S. Application Data continuation of application No. 14/100,131, filed on Dec. 9, 2013, now Pat. No. 9,321,293.

(51) Int. Cl.

| | |
|---|---|
| ***B42F 3/00*** | (2006.01) |
| ***B42C 5/00*** | (2006.01) |
| ***B42B 4/00*** | (2006.01) |

(52) U.S. Cl.

CPC ..... *B42F 3/003* (2013.01); *B31F 2201/0754* (2019.01); *B65H 2301/51616* (2013.01); *G03G 2215/00852* (2013.01)

(58) Field of Classification Search

USPC ..... 270/58.07, 58.08, 58.11, 58.12, 58.17, 270/58.27; 412/33

See application file for complete search history.

(56) References Cited

U.S. PATENT DOCUMENTS

| | | | |
|---|---|---|---|
| 7,300,044 | B2 | 11/2007 | Stemmle |
| 8,246,033 | B2 | 8/2012 | Sato |
| 8,262,075 | B2 | 9/2012 | Shiraishi |
| 8,297,610 | B2 | 10/2012 | Shiraishi |
| 8,333,372 | B2 | 12/2012 | Awaya et al. |
| 8,342,497 | B2 | 1/2013 | Abe |
| 8,459,629 | B2 | 6/2013 | Abe |
| 8,544,835 | B2 | 10/2013 | Abe |
| 2010/0308526 | A1 | 12/2010 | Awaya et al. |
| 2012/0090441 | A1 | 4/2012 | Abe |
| 2013/0214471 | A1 | 8/2013 | Yabe |
| 2013/0270762 | A1 | 10/2013 | Saito |
| 2013/0341856 | A1 | 12/2013 | Takemasa et al. |
| 2014/0003852 | A1 | 1/2014 | Abe et al. |
| 2014/0030000 | A1 | 1/2014 | Gamo et al. |
| 2014/0077437 | A1 | 3/2014 | Abe et al. |

FOREIGN PATENT DOCUMENTS

| | | | |
|---|---|---|---|
| JP | 2011-011913 | A | 1/2011 |
| JP | 2012-027118 | A | 2/2012 |
| JP | 2012-062129 | A | 3/2012 |

OTHER PUBLICATIONS

Office Action dated Jun. 7, 2016, in Japanese Patent Application No. 2015-130478.

SHEET PROCESSING APPARATUS AND IMAGE FORMING APPARATUS

This is a continuation of U.S. patent application Ser. No. 15/068,850, filed Mar. 14, 2016, which is a continuation of U.S. patent application Ser. No. 14/100,131, filed Dec. 9, 2013, now U.S. Pat. No. 9,321,293.

BACKGROUND OF THE INVENTION

Field of the Invention

The present invention relates to a sheet processing apparatus configured to bind a bundle of sheets and an image forming apparatus including the same.

Description of the Related Art

Hitherto, some image forming apparatuses such as a copier, a laser beam printer, a facsimile machine, and a multi-function printer are provided with a sheet processing apparatus configured to perform such processes as stapling on sheets on which images have been formed. Such a sheet processing apparatus is configured to bind a bundle of sheets by using a metallic staple in general. Lately, however, as another method for binding sheets, there is proposed a method of fastening a sheet bundle without using any metallic staple by considering environmental issues by entangling fibers of the sheets by biting the sheet bundle by concavo-convex teeth and forming concavo-convex dents on the sheets as disclosed in Japanese Patent Application Laid-open No. 2010-189101 for example.

However, the sheet processing apparatus described above configured to fasten the sheet bundle by biting the sheet bundle by the concavo-convex teeth has a drawback that although the sheet processing apparatus endows the sheet bundle with a predetermined fastening power in a direction in which the fibers are entangled, the fastening power drops extremely in a direction orthogonal to the direction in which the fibers are entangled. The sheet processing apparatus also has another drawback that it can fasten the sheets only with an extremely low fastening power in fastening the sheet bundle by entangling the fibers if moisture of the sheets is low or smoothness of surfaces of the sheets is high and it is hard to entangle the fibers with each other.

SUMMARY OF THE INVENTION

According to first aspect of the present invention, a sheet processing apparatus controlled by a control portion includes a sheet stacking portion configured to stack sheets and a sheet binding unit having first and second concavo-convex binding teeth disposed such that they engage with each other and performing a binding process by forming a plurality of concavo-convex dents extending in a predetermined direction on a bundle of sheets stacked on the sheet stacking portion by the first and second binding teeth, the sheet binding unit selectively performing a first binding mode of forming the plurality of concavo-convex dents on the sheet bundle by biting the sheet bundle by the first and second binding teeth such that the first and second binding teeth bite across at least one edge of two edges of the sheet bundle and a second binding mode of forming the plurality of concavo-convex dents by biting the sheet bundle by the first and second binding teeth such that the first and second binding teeth bite across none of edges of the sheet bundle.

According to second aspect of the present invention, a sheet processing apparatus includes a sheet stacking portion configured to stack sheets, a sheet binding unit having first concavo-convex binding teeth and second concavo-convex binding teeth disposed so as to engage with the first binding teeth and performing a binding process on a sheet bundle formed on the sheet stacking portion by biting the sheet bundle by the first and second binding teeth, and a positioning mechanism configured to be able to change a relative positional relationship between the sheet binding unit and the sheet bundle formed on the sheet stacking portion such that the relative position is set at a position where the first and second binding teeth intersect with an edge of the sheet bundle in performing the binding process.

Further features of the present invention will become apparent from the following description of exemplary embodiments with reference to the attached drawings.

DESCRIPTION OF THE EMBODIMENTS

Figure 1:
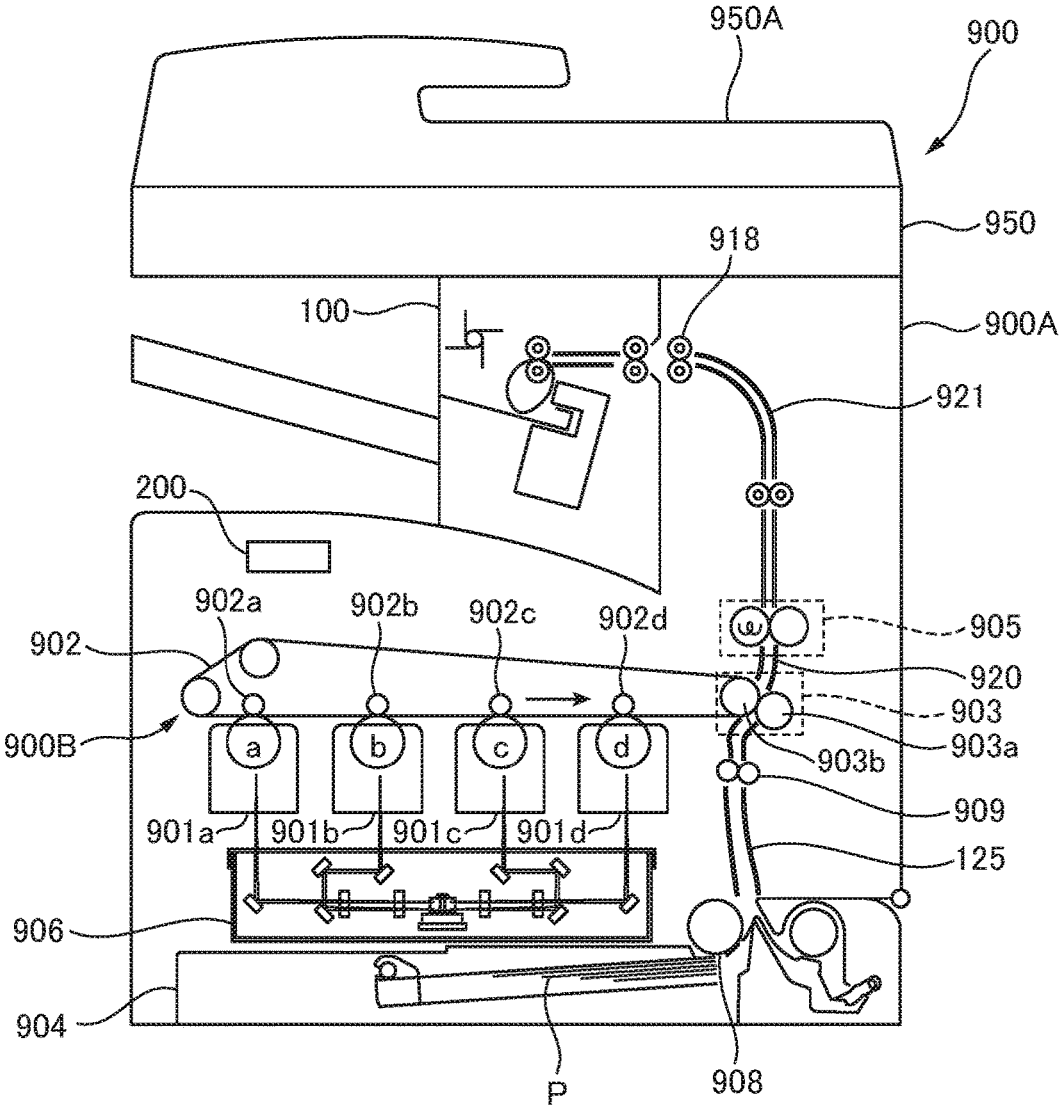
FIG. 1 is a diagram illustrating a configuration of an image forming apparatus provided with a sheet processing apparatus of an embodiment of the invention.

Embodiments for carrying out the present invention will be detailed below with reference to the drawings. FIG. 1 is a diagram illustrating a configuration of an image forming apparatus provided with a sheet processing apparatus of the embodiment of the invention. As shown in FIG. 1, the image forming apparatus 900 includes a body of the image forming apparatus (referred to as an "apparatus body" hereinafter) 900A, an image forming portion 900B configured to form an image on a sheet, an image reading apparatus 950 provided at an upper part of the apparatus body 900A and provided with a document feeder 950A, and a sheet processing apparatus, i.e., a finisher 100, disposed between an upper surface of the apparatus body 900A and the image reading apparatus 950.

The image forming portion 900B includes photoconductive drums (a) through (d) configured to form toner images of four colors of yellow, magenta, cyan and black, and an exposure unit 906 configured to form electrostatic latent images on the photoconductive drums by irradiating laser beams based on image information. It is noted that the photoconductive drums (a) through (d) are driven by motors not shown and are provided respectively with primary chargers, developers, and transfer charge portions not shown disposed around thereof. These devices are unitized as process cartridges 901*a* through 901*d*.

The image forming portion 900B also includes an intermediate transfer belt 902 rotationally driven in a direction of an arrow. The toner images of the respective colors on the photoconductive drums are superimposed sequentially to the intermediate transfer belt 902 by transfer biases applied to the intermediate transfer belt 902 by the primary transfer rollers 902*a* through 902*d*. Thereby, a full-color image is formed on the intermediate transfer belt 902.

A secondary transfer portion 903 transfers the full-color image formed on the intermediate transfer belt 902 to a sheet P. The secondary transfer portion 903 is composed of a secondary transfer confronting rollers 903*b* supporting the intermediate transfer belt 902 and a secondary transfer roller 903*a* in contact with the secondary transfer confronting roller 903*b* through an intermediary of the intermediate transfer belt 902. The image forming portion 900B also includes a registration roller 909, a sheet feed cassette 904, and a pickup roller 908 configured to feed a sheet P stored in the sheet feed cassette 904. A CPU circuit portion 200 is a controller that controls the apparatus body 900A and the finisher 100.

Next, an image forming operation of the image forming apparatus 900 constructed as described above will be described. In response to a start of the image forming operation, the exposure unit 906 irradiates laser lights to the photoconductive drums (a) through (d) based on image information sent from a personal computer or the like not shown at first to sequentially expose surfaces of the photoconductive drums (a) through (d) which are charged homogeneously with predetermined polarity and potential and to form electrostatic latent images on the photoconductive drums (a) through (d). The developers develop and visualize these electrostatic latent images by toners.

For instance, the exposure unit 906 irradiates a laser beam of an image signal of a component color of yellow of a document to the photoconductive drum (a) through a polygon mirror and the like to form an electrostatic latent image of yellow on the photoconductive drum (a). Then, the developer develops the electrostatic latent image of yellow by toner thereof to visualize as a yellow toner image. After that, along with rotation of the photoconductive drum (a), this toner image comes to a primary transfer portion where the photoconductive drum (a) is in contact with the intermediate transfer belt 902. When the toner image comes to the primary transfer portion as described above, the yellow toner image on the photoconductive drum (a) is transferred to the intermediate transfer belt 902 by the primary transfer bias applied from the transfer charger to the primary transfer roller 902*a* (primary transfer).

As a region carrying the yellow toner image of the intermediate transfer belt 902 moves next, a magenta toner image which has been formed similarly on the photoconductive drum (b) up to then is transferred to the intermediate transfer belt 902 and is superimposed on the yellow toner image. In the same manner, as the intermediate transfer belt 902 moves, cyan and black toner images are transferred and superimposed on the yellow and magenta toner images at respective primary transfer portions. Thereby, the full-color toner image is formed on the intermediate transfer belt 902.

Concurrently with the toner image forming operation, the sheets P stored in the sheet feed cassette 904 are sent out one by one by the pickup roller 908. Then, the sheet P reaches the registration roller 909 where timing is adjusted, and is conveyed to the secondary transfer portion 903. In the secondary transfer portion 903, the four color toner images on the intermediate transfer belt 902 is collectively transferred to the sheet P by the secondary transfer bias applied to the secondary transfer roller 903*a*, i.e., the transfer portion (secondary transfer).

Next, the sheet P on which the toner image has been transferred is conveyed from the secondary transfer portion 903 to a fixing portion 905 by being guided by a conveyance guide 920. The toner image is fixed on the sheet P by receiving heat and pressure in passing through the fixing portion 905. After that, the sheet P on which the image has been fixed is conveyed and discharged to the finisher 100 by a discharge roller pair 918 after passing through a discharge path provided downstream of the fixing portion 905.

Here, the finisher 100 performs such processes as sequentially taking in the sheets discharged out of the apparatus body 900A, aligning and bundling the plurality of sheets taken into the finisher 100 as one bundle, and binding an upstream edge in a sheet discharge direction (referred to as a 'rear edge' hereinafter) of the bundled sheet bundle. As shown in FIG. 2, the finisher 100 is provided with a processing portion 139 configured to implement the binding process and to discharge and stack the sheets on a stacking tray 114 as necessary. It is noted that the processing portion 139 includes an intermediate processing tray 107, i.e., a sheet stacking portion, configured to stack sheets to be bound and a binding portion 100A configured to bind the sheets stacked on the intermediate processing tray 107.

Figure 3:
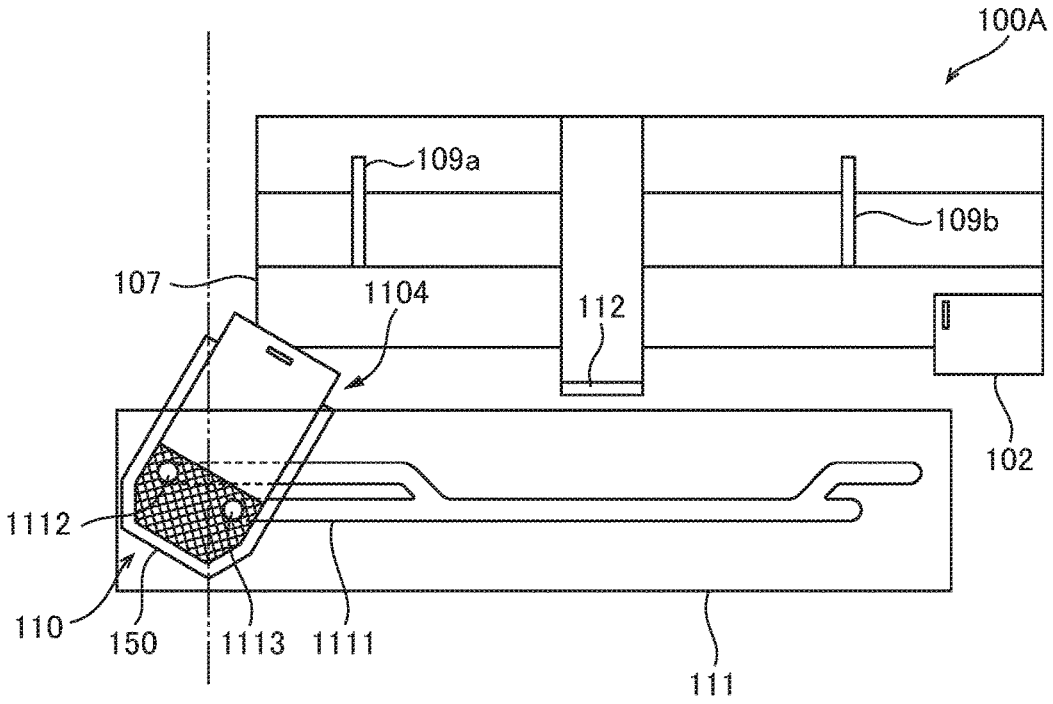
FIG. 3 illustrates a configuration of a binding portion provided in the finisher.

As shown in FIG. 3 and described later, the intermediate processing tray 107 is provided with front and rear aligning plates 109*a* and 109*b* configured to restrict (align) positions of both side edges in a width direction (in a depth direction) of the sheet conveyed from a direction orthogonal to the depth direction of the apparatus body 900A. It is noted that the front and rear aligning plates 109*a* and 109*b*, i.e., side edge aligning portions, that align the widthwise side edge positions of the sheet stacked on the intermediate processing tray 107 are driven and moved in the width direction by an aligning motor M253 shown in FIG. 8 and described later.

The front and rear aligning plates 109*a* and 109*b* are moved to a receiving position for receiving the sheet by the aligning motor M253 normally driven based on a sensing signal of an alignment HP sensor not shown. Then, the front and rear aligning plates 109*a* and 109*b* are moved along the width direction by driving the aligning motor M253 such that they come into contact with the both side edges of the sheets stacked on the intermediate processing tray 107 in restricting the both side edge positions of the sheets.

The finisher 100 is also provided with a draw-in paddle 106 disposed above a downstream in a sheet conveying direction of the intermediate processing tray 107 as shown in FIG. 2. Here, the draw-in paddle 106 is put into a stand-by condition above the intermediate processing tray 107 where the draw-in paddle 106 does not hamper a sheet from being discharged before the sheet is conveyed to the processing portion 139 by a paddle elevating motor M252 driven based on sensing information of a paddle HP sensor S243 shown in FIG. 8 and described later.

As the sheet is discharged to the intermediate processing tray 107, the paddle elevating motor M252 is driven reversely such that the draw-in paddle 106 moves downward, and the draw-in paddle 106 is rotated counterclockwise with adequate timing by a paddle motor not shown. This rotation of the draw-in paddle 106 exerts the sheet to be pulled into the intermediate processing tray 107 and a rear edge, i.e., one end in a discharge direction, of the sheet to abut against a rear edge stopper 108 as shown in FIG. 2B. Here, the draw-in paddle 106, the rear edge stopper 108, and the front and rear aligning plates 109*a* and 109*b* compose an aligning portion 130 that aligns the sheets stacked on the intermediate processing tray 107 in the present embodiment. It is noted that if an inclination of the intermediate processing tray 107 is large for example, it is possible to abut the sheet against the rear edge stopper 108 without using the draw-in paddle 106 or a knurling belt 117 described later.

It is also noted that the finisher 100 is also provided with a rear edge assist 112, i.e., a moving portion, movable along the sheet discharge direction as shown in FIG. 2. The rear edge assist 112 moves from a position where a move of a stapler described later is not hampered to a receiving position where a sheet is received by an assist motor M254 driven based on a sensing signal of an assist HP sensor S244 shown in FIG. 8 and described later. The rear edge assist 112 discharges the sheet bundle to the stacking tray 114 after the binding process implemented on the sheet bundle as described later.

The finisher 100 also includes an inlet roller pair 101 and a discharge roller 103 for taking the sheet into the intermediate processing tray 107. That is, the sheet discharged out of the apparatus body 900A is passed to the inlet roller pair 101. It is noted that at this time, an inlet sensor S240 concurrently detects the sheet passing timing. Then, the discharge roller 103, i.e., a sheet discharge portion, discharges the sheets passed to the inlet roller pair 101 sequentially to the intermediate processing tray 107. After that, a return portion such as the draw-in paddle 106 and the knurling belt 117 abuts the sheet against the rear edge stopper 108. With this arrangement, the sheets are aligned in the sheet conveying direction, and the aligned sheet bundle is formed.

Figure 2A:
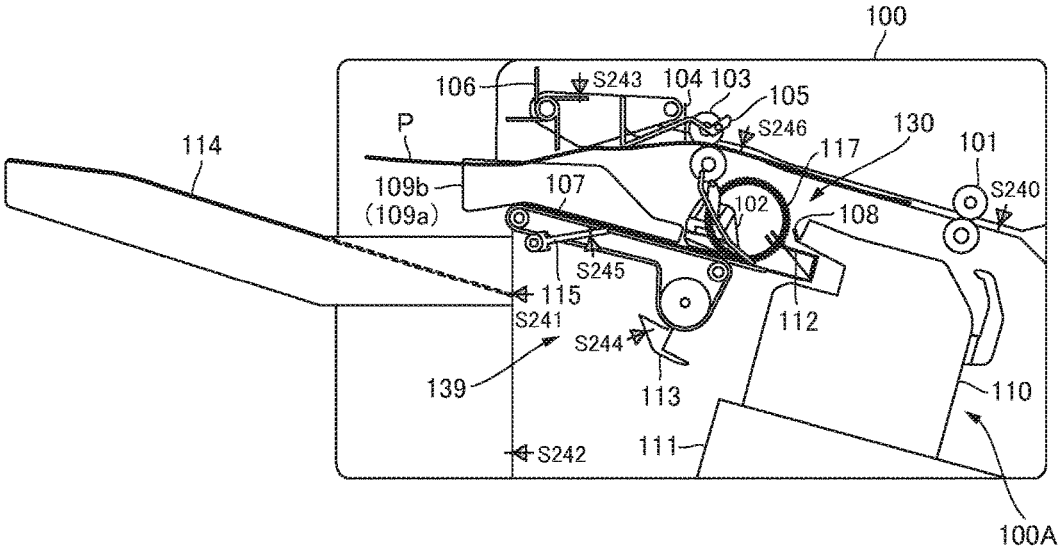
FIG. 2A illustrates a condition in which a sheet is passing through a discharge roller in a finisher, i.e., the sheet processing apparatus.
Figure 2B:
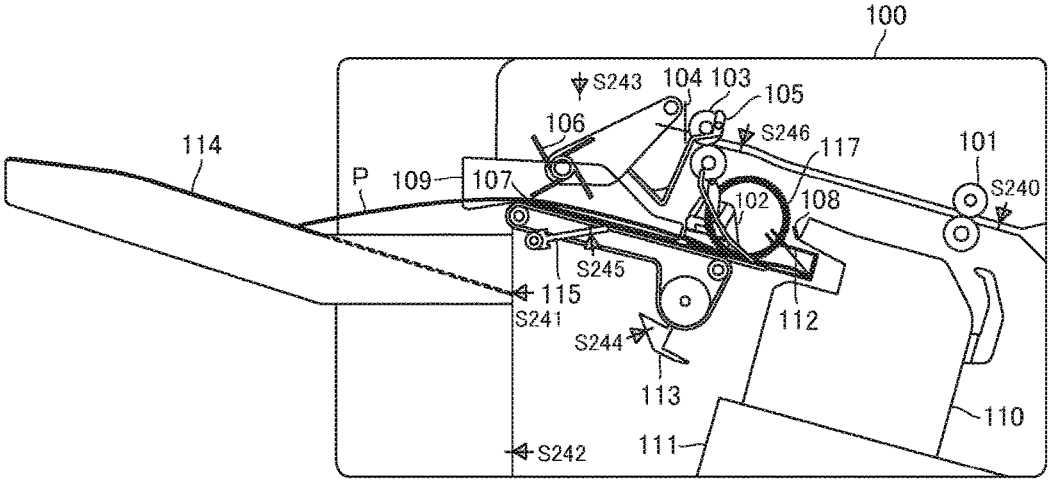
FIG. 2B illustrates a condition in which the sheet is discharged to an intermediate processing tray in the finisher shown in FIG. 2A.

It is noted that the finisher 100 is also provided with a rear edge snap 105 which is pushed up by the sheet passing through the discharge roller 103 as shown in FIG. 2A. As the sheet P passes through the discharge roller 103, the rear edge snap 105 drops by its own weight and presses down the rear edge of the sheet P from the above as shown in FIG. 2B.

The finisher 100 also includes a destaticizing needle 104, a bundle pressor 115 configured to press the sheet bundle stacked on the stacking tray 114 by being rotated by a bundle pressor motor M255 shown in FIG. 8 and described later, a tray lower limit sensor S242, and a bundle pressor HP sensor S245. If a sheet bundle shades a tray HP sensor S241, a tray elevating motor M251 shown in FIG. 8 lowers the stacking tray 114 until when the tray HP sensor S241 becomes transmissive and a sheet surface level is defined.

As shown in FIG. 3, the binding portion 100A includes a stapler 110 which functions as a staple binding portion configured to bind a sheet bundle by a staple, and a staple-less binding unit 102 which functions as a staple-less binding portion configured to bind a sheet bundle without using any staple. It is noted that FIG. 3 shows a condition in which the stapler 110 is located at its HP (home position). Here, the stapler 110, i.e., a first binding unit, that implements a binding process by staples on the sheet bundle is fixed on a stapler base 150.

It is noted that the stapler base 150 is moved by a STP moving motor M258 shown in FIG. 8 and described later such that guide pins 1112 and 1113 of the stapler base 150 are guided by move guiding grooves 1111 provided on a stapler moving base 111. With this arrangement, the stapler 110 moves on the stapler moving base 111 while turning a direction thereof with respect to the sheets.

Figure 4A:
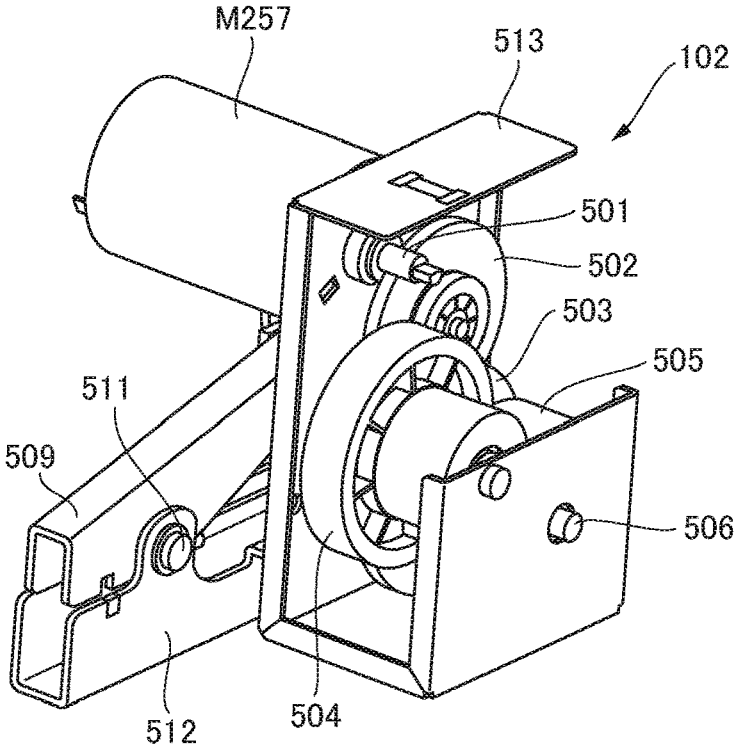
FIG. 4A is a perspective view illustrating a staple-less binding unit provided in the binding portion.

The staple-less binding unit 102, i.e., a second binding unit, implementing the binding process on the sheet bundle without using any staple is provided on a rear side in the depth direction of the apparatus body 900A (referred to as a 'rear side of the apparatus body' hereinafter) more than the intermediate processing tray 107 as shown in FIG. 3. As shown in FIG. 4A, the staple-less binding unit 102 includes a staple-less binding motor M257, a gear 501 rotated by the staple-less binding motor M257, and stage gears 502 through 504 rotated by the gear 501, and a gear 505 rotated by the stage gears 502 through 504. The staple-less binding unit 102 also includes a lower arm 512 fixed to a frame 513 and an upper arm 509 provided swingably with respect to the lower arm 512 centering on a shaft 511 and is biased to a lower arm side by a bias member not shown.

Figure 4B:
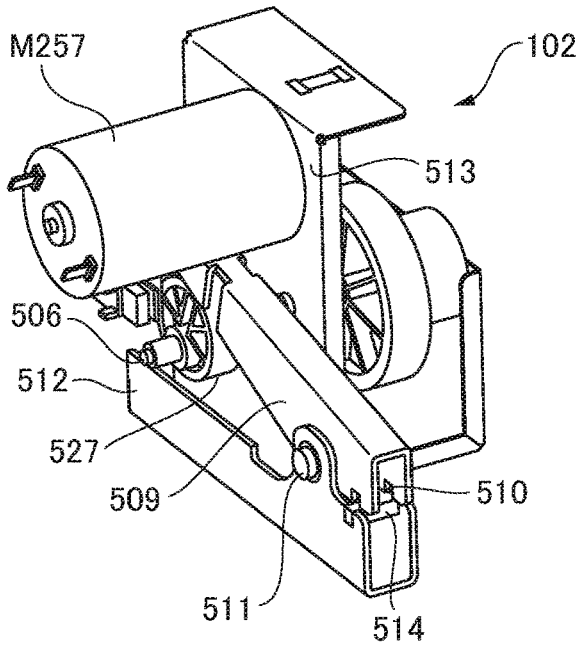
FIG. 4B is a perspective view illustrating the staple-less binding unit viewed from an opposite side from the view in FIG. 4A.

Here, the gear 505 is mounted to a rotary shaft 506. Then, the rotary shaft 506 is provided with a cam 527 which is mounted thereto and is provided between the upper and lower arms 509 and 512 as shown in FIG. 4B. With this arrangement, as the staple-less binding motor M257 rotates, the rotation of the staple-less binding motor M257 is transmitted to the rotary shaft 506 through the gear 501, the stage gears 502 through 504, and the gear 505, and rotates the cam 527.

Figure 5A:
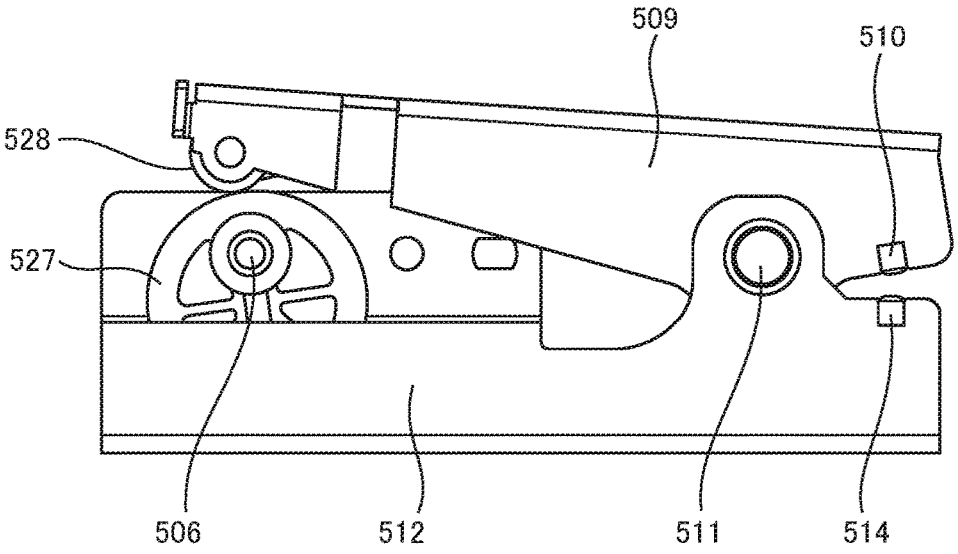
FIG. 5A illustrates the staple-less binding unit in a condition in which upper and lower teeth are disengaged.
Figure 5B:
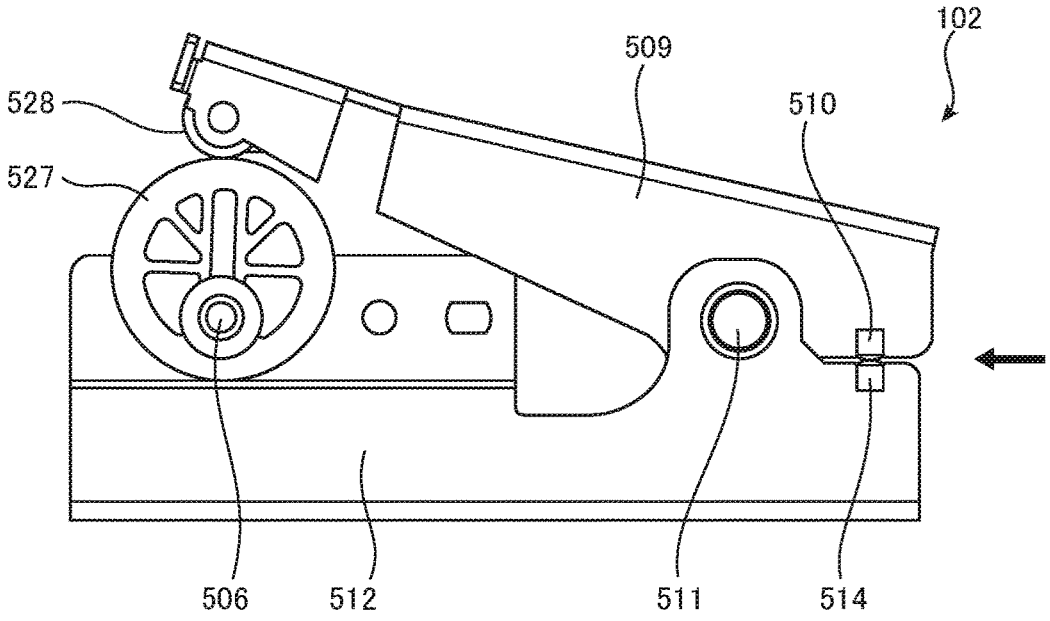
FIG. 5B illustrates the staple-less binding unit in a condition in which the upper and lower teeth are engaged.

When the cam 527 thus rotates, a cam-side end portion of the upper arm 509 in pressure contact with the cam 527 through an intermediary of a roller 528 as shown in FIG. 5A by being biased by a bias member not shown rises as shown in FIG. 5B. Here, the upper arm 509 is provided with upper teeth (first binding teeth) 510, i.e., a concavo-convex portion having concavo-convex teeth, attached at a lower end of an end portion thereof on a side opposite from the cam 527, and the lower arm 512 is provided with lower teeth (second binding teeth) 514, i.e., a concavo-convex portion having concavo-convex teeth, disposed at an upper end of an end portion thereof on a side opposite from the cam 527. It is noted that the lower teeth 514 are formed such that they project upward and the upper teeth 510 are formed such that they project downward, and the pair of lower and upper teeth 514 and 510 is disposed such that the pluralities of concavo-convex teeth engage with each other.

With this arrangement, the end portion on the side opposite from the cam 527 of the upper arm 509 is lowered as the cam-side end portion of the upper arm 509 rises and along with that, the upper teeth 510 move downward and engage with the lower teeth 514, thus pressing the sheets interposed between the upper and lower teeth. When the sheets are pressed as described above, fibers of surfaces of the sheets P are exposed as the sheets P are stretched. By being pressed further, the fibers of the sheets are entangled with each other and are fastened. That is, the sheets are fastened by the binding process carried out on the sheets by pressure-engaging the sheets by the upper teeth 510 of the upper arm 509 and the lower teeth 514 of the lower arm 512 by swinging the upper arm 509.

Figure 6:
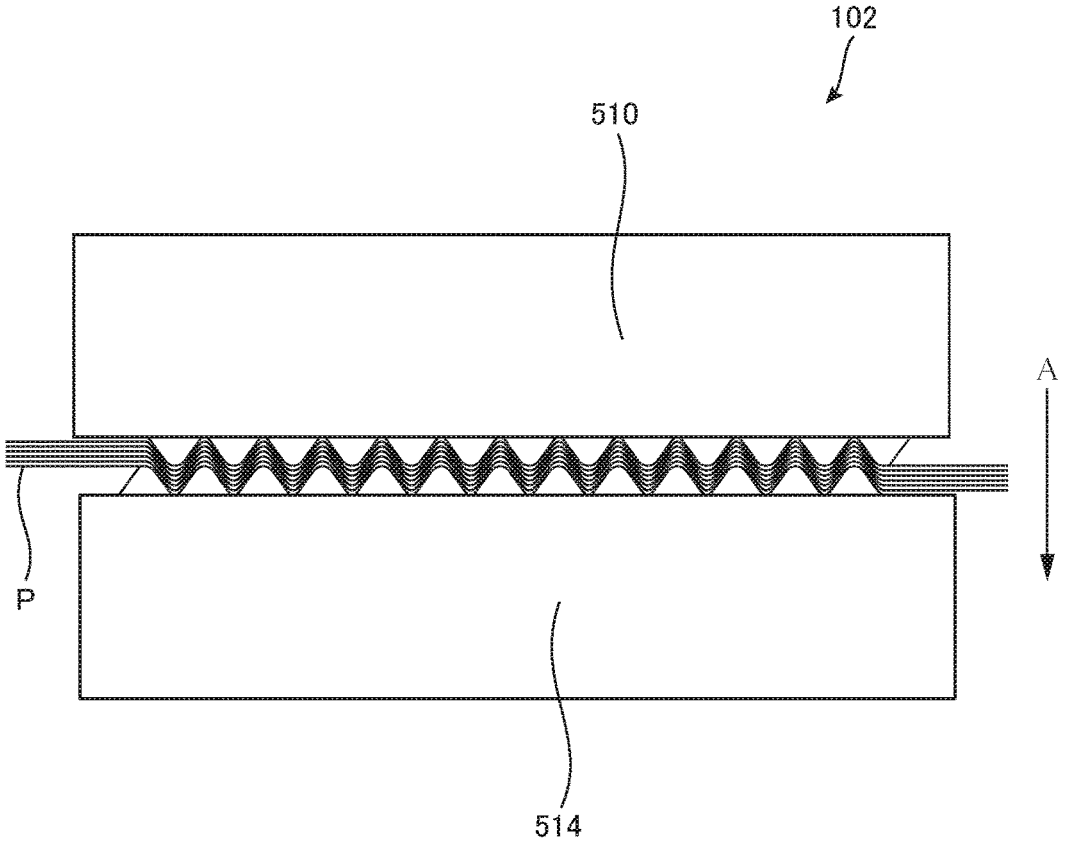
FIG. 6 is a section view illustrating a condition of the sheets bound without a staple by the staple-less binding unit.

It is noted that FIG. 6 is a section view illustrating a condition of a bundle of five sheets P bound by the staple-less binding unit 102 without staples. The sheets Pare fastened by causing the entanglement of the fibers of the sheets P with each other while forming concavo-convex dents by pressing the sheets by the upper and lower teeth 510 and 514. Fastening of the sheets P by means of the entanglement of the fibers will described later in detail with reference to FIG. 13.

Figure 7:
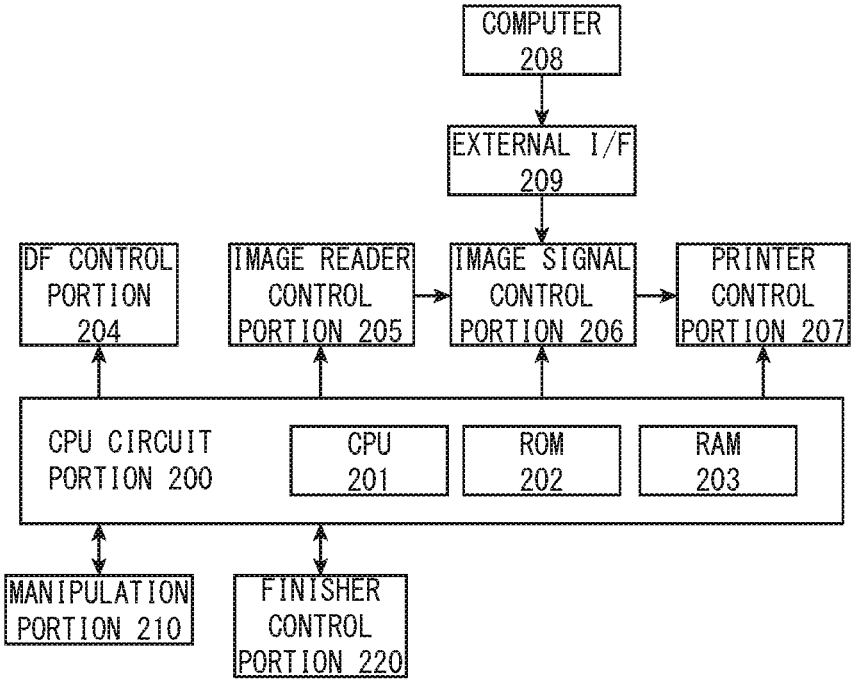
FIG. 7 is a control block diagram of the image forming apparatus.

FIG. 7 is a control block diagram of the image forming apparatus 900. A CPU circuit portion 200 also shown in FIG. 8 is disposed at a predetermined position of the apparatus body 900A as shown in FIG. 1. The CPU circuit portion 200 includes a CPU 201, a ROM 202 storing a control program and others, and a RAM 203 used as an area for temporarily storing control data and as a work area for calculations involved in controls.

As shown in FIG. 7, an external interface (I/F) 209 serves as an interface between the image forming apparatus 900 and an external personal computer 208. Receiving print data from the computer 208, the external I/F 209 develops the data as a bit map image and outputs it as image data to an image signal control portion 206.

Then, the image signal control portion 206 outputs the data to a printer control portion 207, and the printer control portion 207 outputs the data from the image signal control portion 206 to an exposure control portion not shown. It is noted that an image of a document read by an image sensor not shown and provided in an image reader 950 is output from an image reader control portion 205 to the image signal control portion 206, and the image signal control portion 206 outputs this image output to the printer control portion 207.

A manipulation portion 210 includes a display or the like that displays a plurality of keys and preset conditions for setting various functions concerning image forming processes. The manipulation portion 210 outputs a key signal corresponding to each key manipulated by a user to the CPU circuit portion 200, and displays corresponding information on the display based on a signal from the CPU circuit portion 200.

The CPU circuit portion 200 controls the image signal control portion 206 in accordance to a control program stored in the ROM 202 and to setting made through the manipulation portion 210 and also controls a document feeder 950A (see FIG. 1) through a DF (document feeder) control portion 204. The CPU circuit portion 200 also controls the image reader 950 (see FIG. 1) through an image reader control portion 205, the image forming portion 900B (see FIG. 1) through the printer control portion 207, and the finisher 100 through a finisher control portion 220, respectively.

It is noted that the finisher control portion 220 is mounted in the finisher 100 and drives and controls the finisher 100 by exchanging information with the CPU circuit portion 200 in the present embodiment. It is also possible to arrange such that the finisher control portion 220 is disposed on the apparatus body side integrally with the CPU circuit portion 200 and to control the finisher 100 directly from the apparatus body side.

Figure 8:
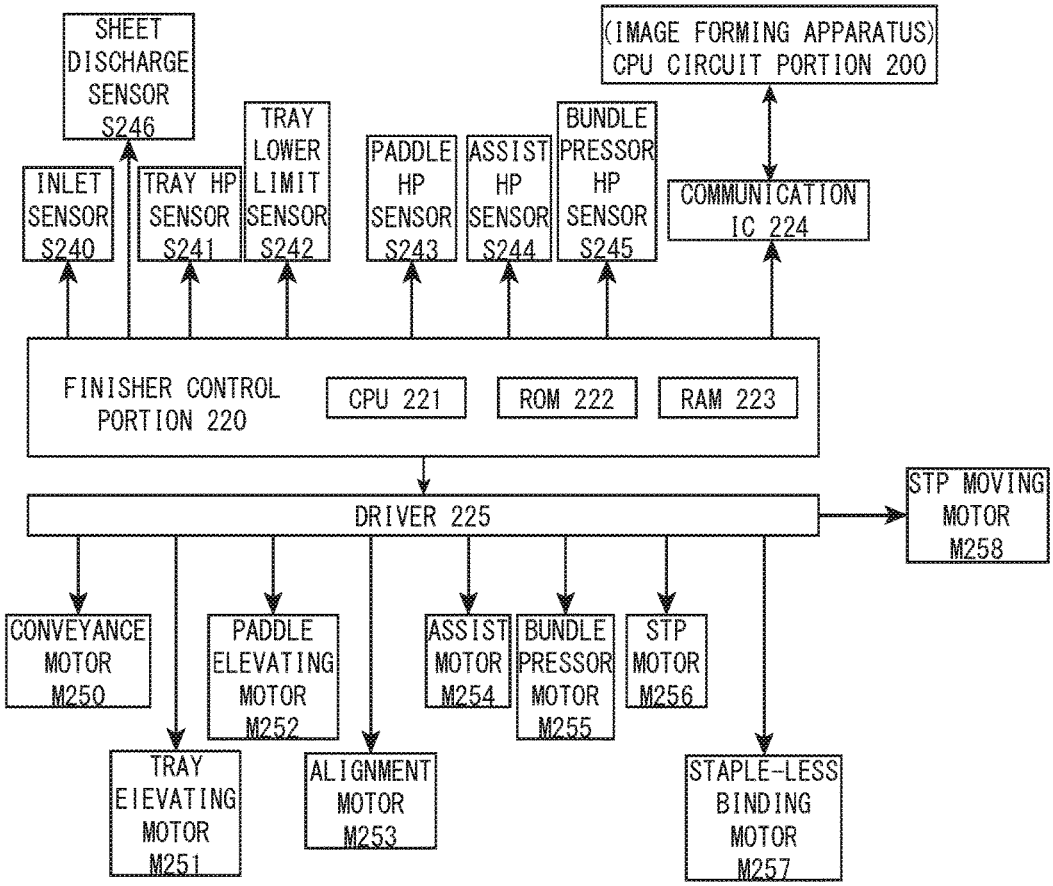
FIG. 8 is a control block diagram of the finisher.

FIG. 8 is a control block diagram of the finisher 100 of the present embodiment. The finisher control portion 220 is composed of a CPU (microcomputer) 221, a ROM 222, and a RAM 223. The finisher control portion 220 communicates and exchanges data with the CPU circuit portion 200 through a communication IC 224, and executes various programs stored in the ROM 222 based on an instruction from the CPU circuit portion 200 to control drives of the finisher 100.

The finisher control portion 220 also drives the conveyance motor M250, the tray elevating motor M251, the paddle elevation motor M252, the aligning motor M253, the assist motor M254, and the bundle pressor motor M255 through a driver 225. The finisher control portion 220 drives the STP motor M256, the staple-less binding motor M257, the STP moving motor M258 and others through the driver 225.

The finisher control portion 220 is also connected with the inlet sensor S240, the discharge sensor S246, the tray HP sensor S241, the tray lower limit sensor S242, the paddle HP sensor S243, the assist HP sensor S244, and the bundle pressor HP sensor S245. Based on sensing signals from these sensors, the finisher control portion 220 drives the aligning motor M253, the STP moving motor M258, the staple-less binding motor M257 and others.

Next, a sheet binding operation of the finisher 100 of the present embodiment will be explained. The sheet P discharged out of the image forming apparatus 900 is passed to the inlet roller pair 101 driven by the conveyance motor M250 as shown in FIG. 2A already described. In the same time, the inlet sensor S240 detects the sheet passing timing by sensing a front edge of the sheet P.

Next, the sheet P passed to the inlet roller pair 101 is passed from the inlet roller pair 101 to the discharge roller 103, is conveyed while lifting the rear edge snap 105 by the front edge thereof, and is discharged to the intermediate processing tray 107 while being destaticized by the destaticizing needle 104. The sheet P discharged to the intermediate processing tray 107 by the discharge roller 103 is pressed from above by own weight of the rear edge snap 105, so that it is possible to shorten a time during which the rear edge of the sheet P drops on the intermediate processing tray 107.

Next, the finisher control portion 220 controls processes within the intermediate processing tray 107 based on a signal of the rear edge of the sheet P sensed by the discharge sensor S246. That is, as shown in FIG. 2B and described above, the draw-in paddle 106 is lowered to the intermediate processing tray 107 side by the paddle elevating motor M252 to bring into contact with the sheet P. Because the draw-in paddle 106 is rotated counterclockwise at this time by the conveyance motor M250, the sheet P is conveyed to the rear edge stopper 108 side in a right direction in FIG. 2B by the draw-in paddle 106 and after that, the rear edge of the sheet P is passed to the knurling belt 117. It is noted that as the rear edge of the sheet P is passed to the knurling belt 117, the paddle elevating motor M252 drives the draw-in paddle 106 in a direction in which the paddle 106 is lifted, and as the paddle HP sensor S243 senses that the draw-in paddle 106 reaches its HP, the finisher control portion 220 stops the drive of the paddle elevating motor M252.

Figure 9A:
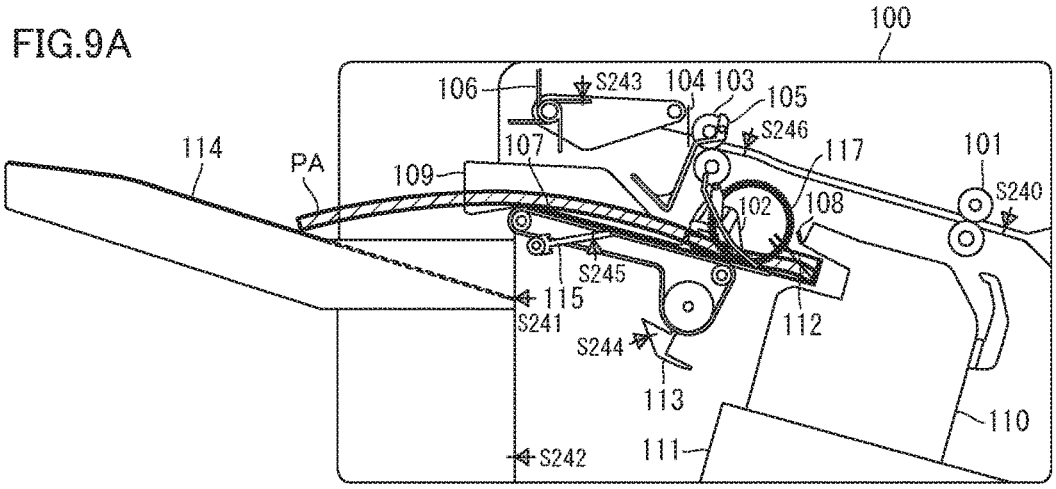
FIG. 9A illustrates the finisher in forming a sheet bundle on the intermediate processing tray.

After conveying the sheet P to the rear edge stopper 108 that has been passed by the draw-in paddle 106, the knurling belt 117 keeps biasing the sheet P to the rear edge stopper 108 by rotating with respect to the sheet P in slidable contact. It is possible to correct a skew of the sheet P by abutting the sheets P against the rear edge stopper 108 by the conveyance in the slidable contact. Next, after abutting the sheets against the rear edge stopper 108 as described above, the finisher control portion 220 drives the aligning motor M253 to move the aligning plates 109 in the width direction orthogonal to the sheet discharge direction and aligns the widthwise position of the sheets P. The finisher control portion 220 forms a sheet bundle PA aligned on the intermediate processing tray 107 as shown in FIG. 9A by repeating a series of these operations to a predetermined number of sheets to be bound.

Figure 9B:
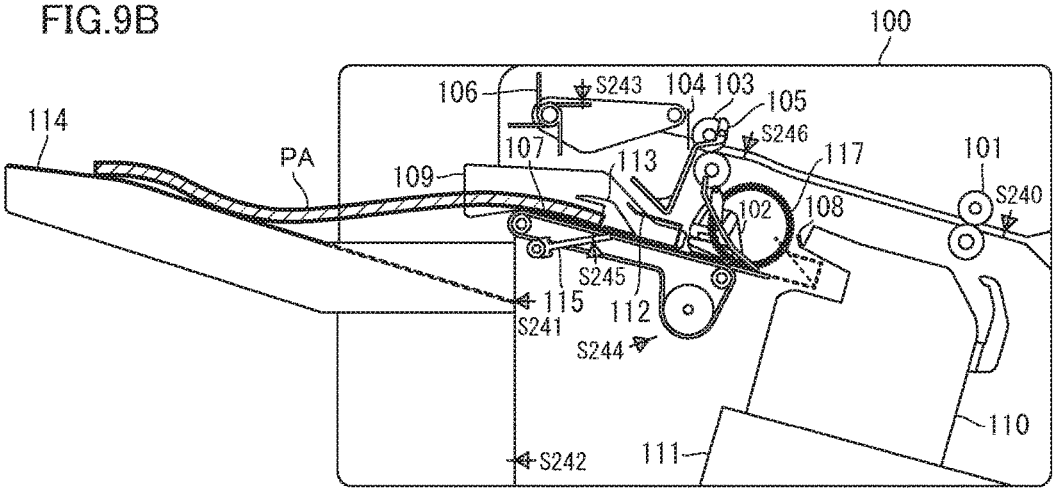
FIG. 9B illustrates the finisher in transferring the sheet bundle to a stacking tray.

Next, if the binding mode is selected to be carried out after the aligning operation described above, the binding portion implements the binding process. After the binding process, a rear edge assist 112 and a discharge claw 113 driven together by the assist motor M254 pushes a rear edge of the sheet bundle PA as shown in FIG. 9B such that the sheet bundle PA on the intermediate processing tray 107 is discharged to the stacking tray 114 as a bundle.

Figure 9C:
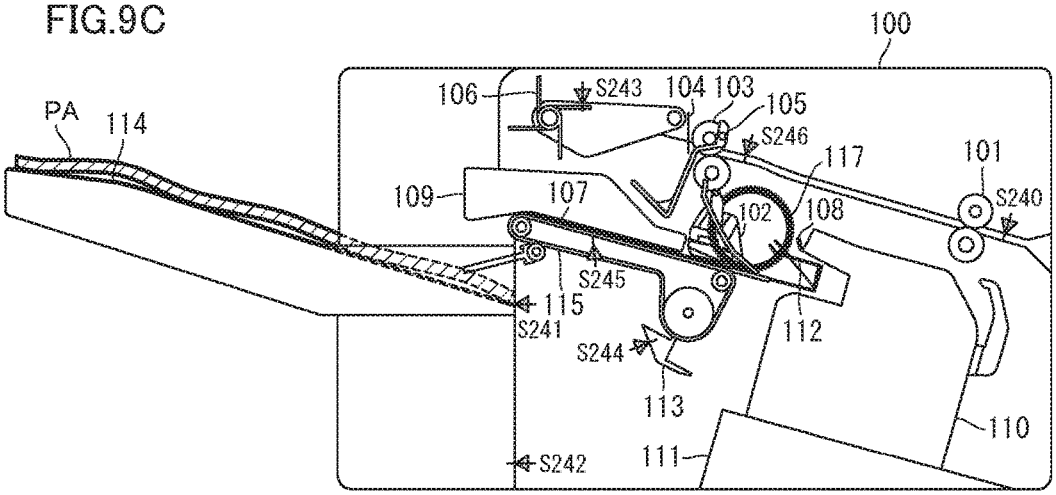
FIG. 9C illustrates the finisher in a condition in which the sheet bundle has been discharged to the stacking tray.

It is noted that the bundle pressor 115 rotates counterclockwise after that to press the rear edge portion of the sheet bundle PA as shown in FIG. 9C to prevent the sheet bundle PA stacked on the stacking tray 114 from being pushed out in the sheet discharge direction by a following sheet bundle. Then, after completing the bundle pressing operation performed by the bundle pressor 115, the stacking tray 114 is lowered by the tray elevating motor M251 until when the tray HP sensor S241 is cleared, if the sheet bundle PA shades the tray HP sensor S241, to define a sheet surface level. It is possible to discharge a required number of sheet bundles PA on the stacking tray 114 by repeating a series of the operations described above.

It is noted that if the stacking tray 114 moves downward and shades the tray lower limit sensor S242 during the operation, the finisher control portion 220 notifies that the stacking tray 114 is fully loaded to the CPU circuit portion 200 of the image forming apparatus 900, and the image forming apparatus 900 stops forming images. Then, as the sheet bundle on the stacking tray 114 is removed, the stacking tray 114 elevates to the level of shading the tray HP sensor S241. After that, the sheet surface level of the stacking tray 114 is defined again as the tray 114 moves downward and the tray HP sensor S241 is cleared. Thereby, the image forming operation of the image forming apparatus 900 is started again.

By the way, the binding portion 100A is provided with the stapler 110 and the staple-less binding unit 102 in the present embodiment as described above and as shown in FIG. 3. The user then selects a staple job of binding a sheet bundle by a staple or a staple-less binding job of binding a sheet bundle without using any staple from the manipulation portion 210 of the image forming apparatus 900 or from the external PC 208.

Figure 10A:
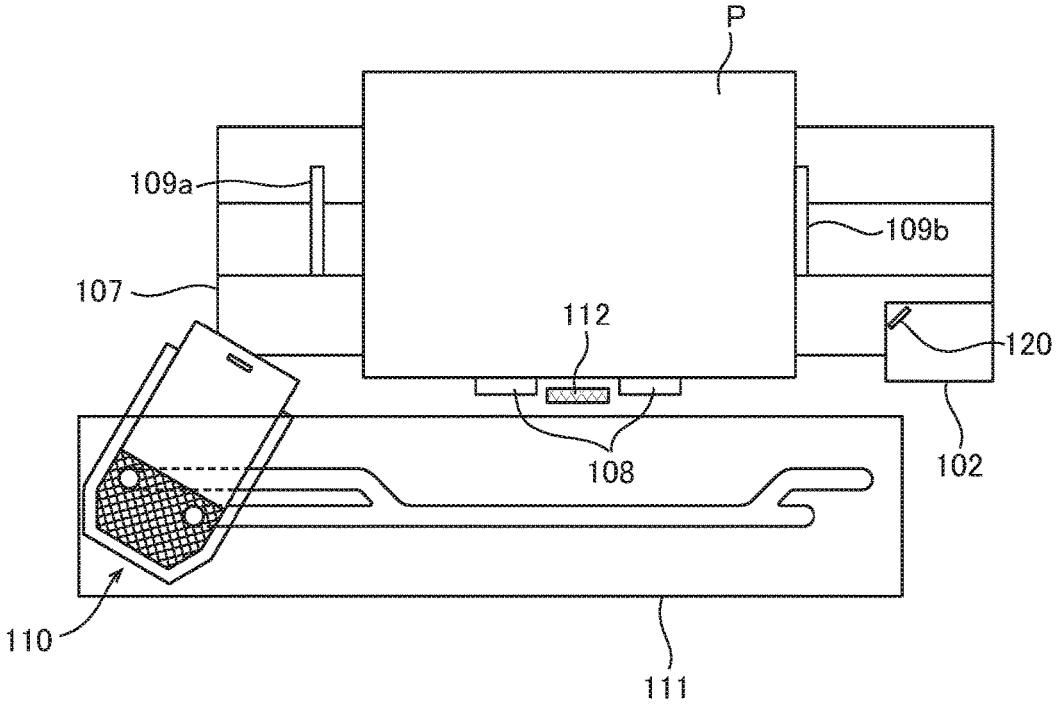
FIG. 10A illustrates a condition in which a sheet to be bound by the staple-less binding unit is discharged on the intermediate processing tray.

If the user selects and sets the staple-less binding job in a print job through the manipulation portion 210 or through setting of the printer for example, the sheet P is aligned at a center of the intermediate processing tray 107 by the front and rear aligning plates 109*a* and 109*b* as shown in FIG. 10A in the present embodiment. The sheet P discharged by the discharge roller 103 in this condition is returned to the rear edge stopper 108 by being conveyed by the knurling belt 117 in addition to the force applied by the draw-in paddle 106 in the direction opposite from the sheet conveying direction.

After when the rear edge of the sheet P is returned to the rear edge stopper 108, a widthwise aligning operation of the sheet P is carried out by moving the front aligning plate 109*a* so as to push the sheet P to the rear aligning plate 109*b*. After carrying out this sheet aligning operation one by one by a number of times, i.e., by a required number of sheets composing a sheet bundle, the sheet bundle is conveyed as a bundle from the aligning position to a staple-less binding position in order to carry out the staple-less binding operation by the staple-less binding unit 102.

Figure 10B:
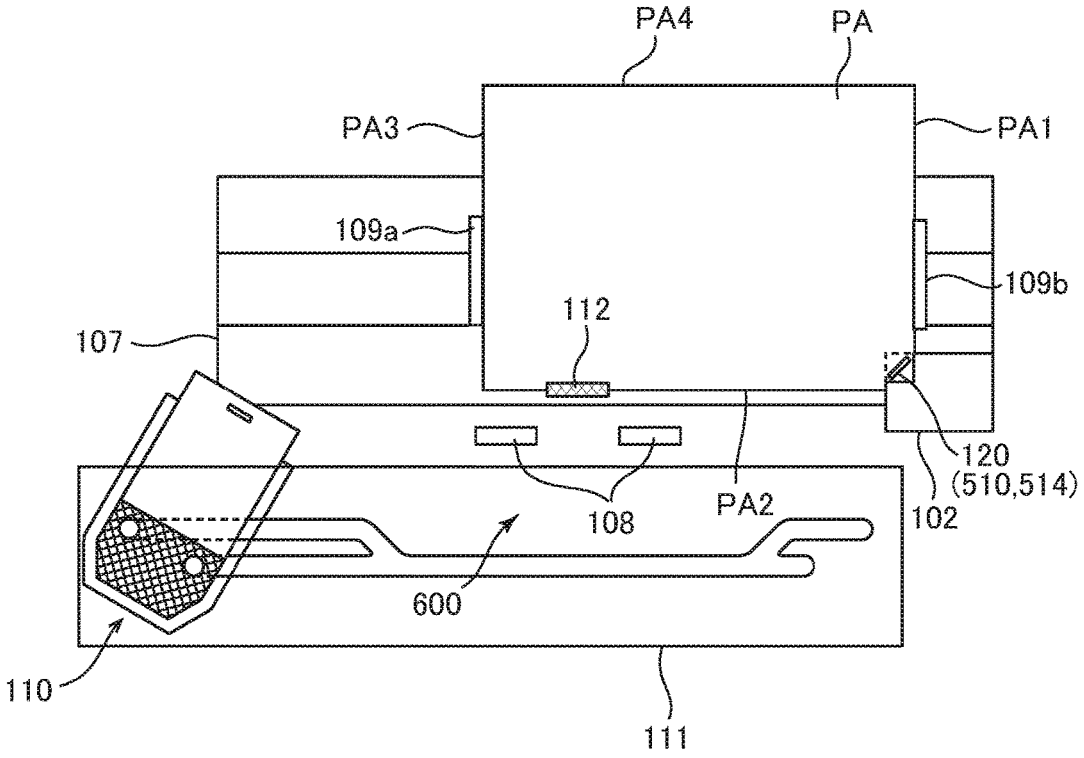
FIG. 10B illustrates a condition in performing a staple-less binding process in a second binding mode.

Here, the finisher 100 functioning as the sheet processing apparatus has first and second binding modes as the binding modes for binding the sheet bundle by the staple-less binding unit 102, i.e., the sheet binding unit, in the present embodiment. Specifically, in the staple-less binding process, a tooth portion 120 composed of the pair of upper and lower teeth 510 and 514 bites the sheet bundle PA and forms a plurality of concavo-convex dents (bound dents, bound part) 1000 (see FIGS. 11A and 11B) that extends in a predetermined direction as shown in FIGS. 10B and 12. In the second binding mode, a relative positional relationship between the sheet bundle PA and the upper teeth (first binding teeth) 510 and the lower teeth (second binding teeth) 514 is set such that the upper and lower teeth 510 and 514 do not bite across, in engaging with each other, none of edges PA1 through PA4 of the sheet bundle PA as shown in FIG. 10B. That is, the upper and lower teeth 510 and 514 bite the sheet bundle PA such that a range of the concavo-convex dents formed by the upper and lower teeth 510 and 514 do not intersect with the edges PA1 through PA4 of the sheet bundle PA. In the first binding mode on the other hand, the relative positional relationship between the sheet bundle PA and the upper and lower teeth 510 and 514 is set such that the upper and lower teeth 510 and 514 bite across, in engaging with each other, the edges PA1 and PA2 of the sheet bundle PA as shown in FIG. 12. That is, the upper and lower teeth 510 and 514 bite the sheet bundle PA such that a range of the concavo-convex dents formed by the upper and lower teeth 510 and 514 intersects with the two edges PA1 and PA2 of the sheet bundle PA. These first and second binding modes will be described in detail below. It is noted that the plurality of concavo-convex dents 1000 described above will be denoted as concavo-convex dents 1001 and 1002, respectively, in distinguishing them in the first and second binding modes.

In the second binding mode described above, the finisher control portion 220 moves the front and rear aligning plates 109*a* and 109*b* in the width direction and moves the rear edge assist 112 downstream in the sheet discharge direction. At this time, the finisher control portion 220 controls moving distances of the front and rear aligning plates 109*a* and 109*b* and of the rear edge assist 112 to move the sheet bundle PA to a position where the tooth portion 120 does not bite across the sheet edges PA1 and PA2 as shown in FIG. 10B. After that, the staple-less binding unit 102 carries out the binding process on a widthwise corner on a side of the rear edge stopper 108, i.e., an area in which no image is formed on the sheets, of the sheet bundle PA.

Figure 11A:
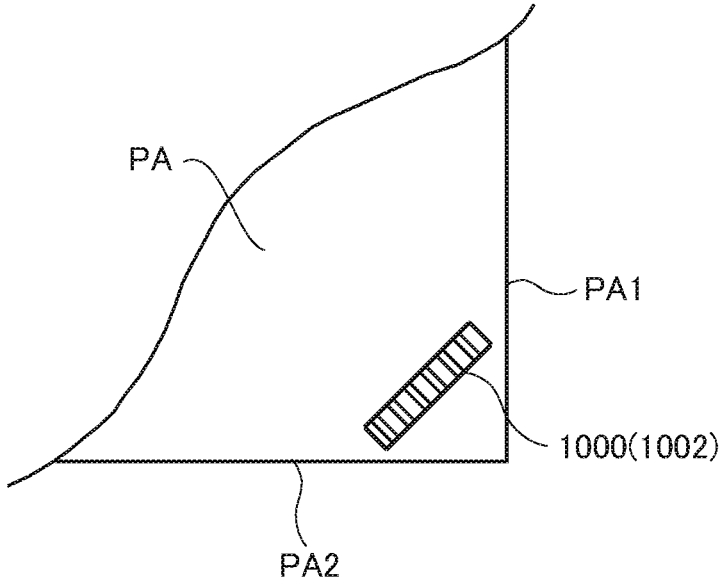
FIG. 11A is an enlarged view illustrating a part bound without a staple in the second binding mode.
Figure 12:
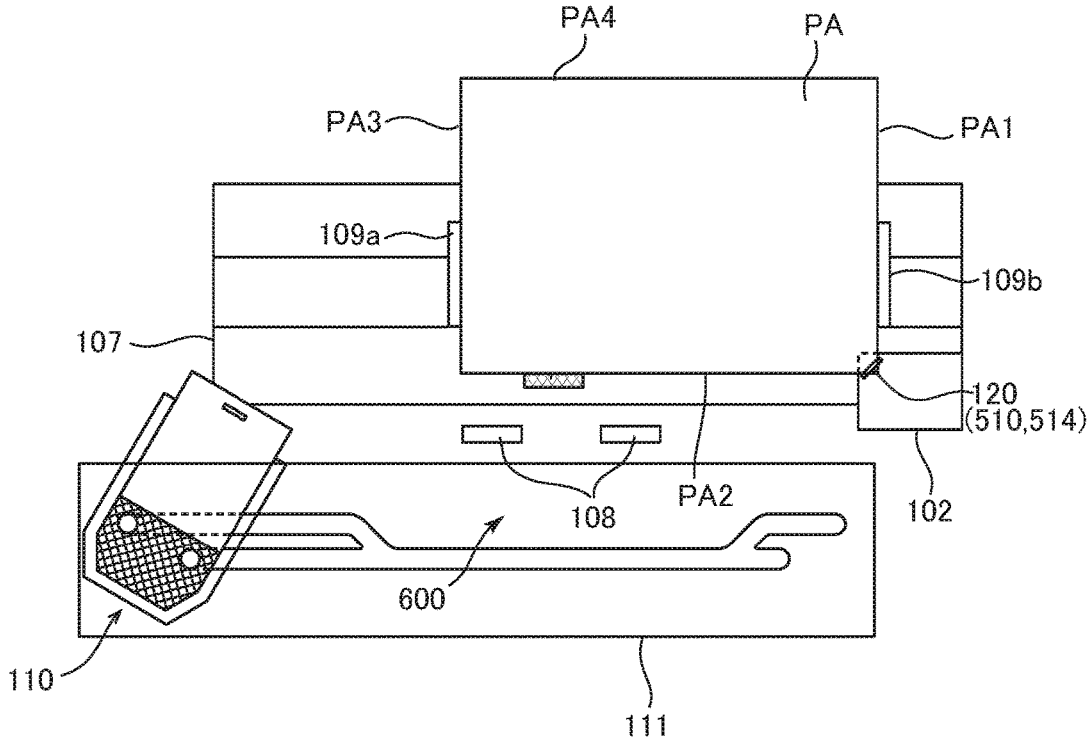
FIG. 12 illustrates a binding process in the first binding mode performed by the staple-less binding unit.

If the binding process in the second binding mode is to be carried out here, the plurality of concavo- and concave dents 1002 is formed on the sheet bundle PA as shown in FIG. 11A. That is, because the tooth portion 120 does not bite the sheet bundle PA such that both ends thereof bite across the edges of the sheet bundle in executing the binding process, the plurality of concavo-convex dents 1002 is not formed to positions of the edges PA1 and PA2 of the sheet bundle PA. Accordingly, the sheets are not fastened around the edges PA1 and PA2 of the sheet bundle PA, so that it becomes easy to turn and separate the sheets from a same direction with a direction in which the teeth, i.e., tooth-like concavo-convex projections, of the upper and lower teeth 510 and 514 are lined up.

In the first binding mode on the other hand, the sheet bundle PA is conveyed by the rear edge assist 112 and the front and rear aligning plates 109*a* and 109*b* to the staple-less binding position where the tooth portion 120 bites across the two edges of the sheet bundle PA as shown in FIG. 12. After that, the staple-less binding unit 102 performs the binding process on a widthwise corner of the end portion on the rear edge stopper side of the sheet bundle PA.

Figure 11B:
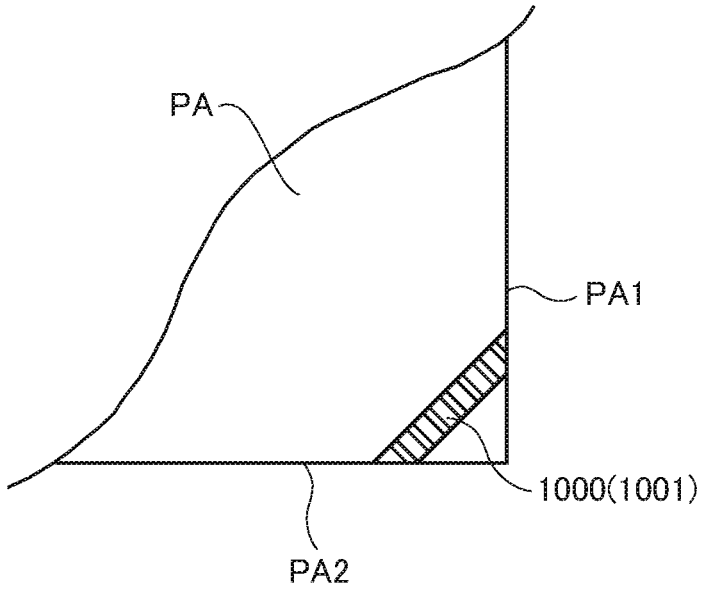
FIG. 11B is an enlarged view illustrating a part bound without a staple in a first binding mode.

Here, in the first binding mode, the plurality of concavo-convex dents 1001 is formed on the sheet bundle PA as shown in FIG. 11B. That is, because the tooth portion 120 binds the sheet bundle PA in the condition in which the tooth portion 120 bites across (extends out of) the two edges of the sheet bundle PA, the plurality of concavo-convex dents 1001 is formed up to the edges PA1 and PA2 of the sheet bundle PA. Accordingly, the sheets are fastened also at the edges PA1 and PA2 of the sheet bundle PA, so that it is hard to turn the sheets from the same direction with the direction in which the teeth, i.e., the tooth-like concavo-convex projections, of the upper and lower teeth 510 and 514 are lined up.

That is, the sheets can be easily turned at the both edges of the sheet bundle when the sheet bundle is bound in the second binding mode, because there exists no part (fastened part) where the fibers are entangled on the both sides in the direction in which the teeth of the upper and lower teeth 510 and 514 are lined up. Meanwhile, because the sheet bundle PA is fastened in the condition in which the upper and lower teeth 510 and 514 bite across (extend out of) the edges of the sheets in the first binding mode, the part in which the fibers are entangled (fastened part) exists up to the edges of the sheet bundle and it becomes hard to turn the sheets. As a result, a force in the direction orthogonal to the direction in which the fibers are entangled becomes hard to be applied, and separation of the sheets becomes hard to occur in turning the sheets. That is, in the first binding mode, it becomes harder to separate the sheets P because it becomes hard to turn the sheets and to apply the force in the direction orthogonal to the direction in which the fibers are entangled even if one tries to turn the sheets from the same direction with the line-up direction of the teeth (dents) of the upper and lower teeth 510 and 514. It is noted that the sheet bundle P is maintained with a predetermined fastening power either in the first or second binding mode even if one tries to turn the sheet in a direction orthogonal to the line-up direction of the teeth (dents).

Note that the rear edge stopper 108, the front and rear aligning plates 109*a* and 109*b* and the rear edge assist 112 compose a positioning mechanism 600 capable of changing the relative positional relationship between the staple-less binding unit 102 and the sheet bundle PA formed on the intermediate processing tray.

That is, the positioning mechanism 600 makes it possible to selectively set the relative position of the staple-less binding unit 102 and the sheet bundle PA in performing the binding process to the position where the upper and lower teeth 510 and 514 intersect with the edges PA1 and PA2 of the sheet bundle PA and to the position where the upper and lower teeth 510 and 514 intersect with none of the edges PA1 through PA4 of the sheet bundle PA.

Figure 13A:
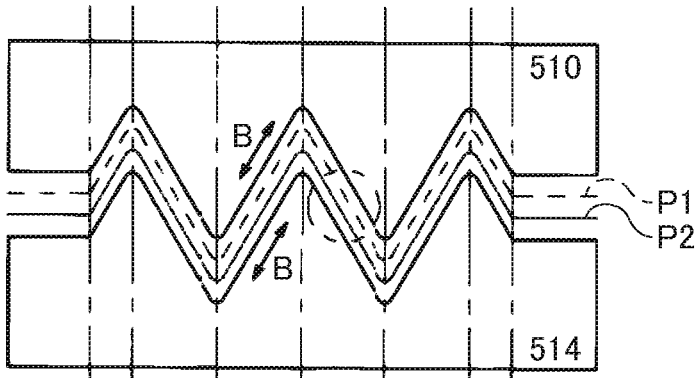
FIG. 13A illustrates a condition in which a sheet bundle is fastened by the staple-less binding unit.
Figure 13B:
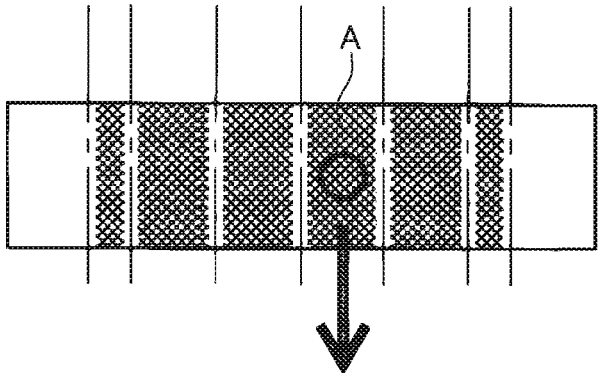
FIG. 13B is a plan view of teeth of the staple-less binding unit.

Here, the fastening operation of the sheet bundle achieved by the entanglement of the fibers in the staple-less binding process will be explained with reference to FIGS. 13A through 13C. As shown in FIG. 13A, sheets P1 and P2 to be bound are interposed between the upper and lower teeth 510 and 514. As the upper teeth 510 is lowered by the drive portion described above in this condition, a great force is applied on the sheets P1 and P2 in a direction of arrows B because the sheets P1 and P2 are pressed by high pressure at slopes of the tooth-marks hatched in FIG. 13B showing a plan view of the tooth-marks viewed from above thereof. As a result, the fibers on the surfaces of the sheets are exposed and are entangled by entangling the exposed fibers as described above. Then, the fibers are fastened with each other by pressing in high pressure also after that.

Figure 13C:
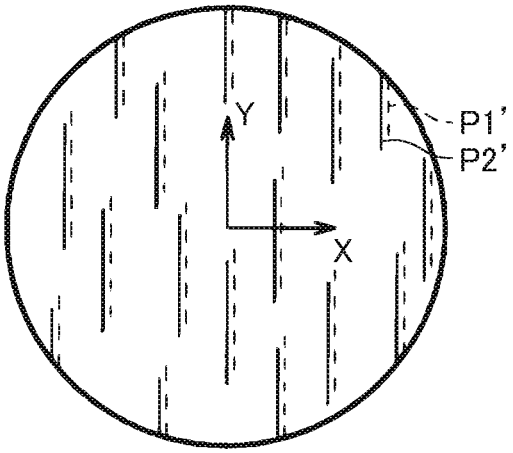
FIG. 13C is an enlarged view diagrammatically illustrating entanglements of fibers of the sheets.

FIG. 13C is an enlarged view diagrammatically showing the entanglement of the fibers. The fibers P1' and P2' of the sheets P1 and P2 are entangled while being pressed in the direction of the arrows B in a certain portion A of the slopes of the teeth, so that the fibers entangle with each other in a longitudinal direction Y in FIG. 13C. Due to that, although the fastening power of the sheets P1 and P2 is strong in the Y direction in which the teeth move, the fastening power is weak in an X direction in which the fibers are less entangled.

By the way, the more the number of sheets to be bound, the more the great pressurizing force is required in binding and fastening the sheets by pressing the sheets. It becomes also harder to entangle fibers in fastening sheets whose smoothness is high because friction between the sheets is low in pressing the sheets and the fibers on surfaces of the sheets are not exposed. Besides that, if moisture of the sheets is low or a modulus of rupture of elongation of the sheets is low, it becomes difficult to fasten the sheets because the fibers on the surfaces of the sheets do not elongate so much and the fibers rupture by themselves before entangling with each other.

Thus, it becomes harder to entangle the fibers and to bind the sheets depending on the smoothness, moisture and the like of the sheets. Here, it is possible to fasten such sheets even under such hard condition to fasten the sheets by selecting the first mode of entangling the fibers of the sheets at the edges of the sheets and of enhancing a contact pressure by reducing a depress area.

Then, the present embodiment is arranged such that the two modes described above can be switched corresponding to the number of sheets to be bound, smoothness, moisture, modulus of rupture of elongation or the like that affect the fastening power of the sheets exerted by the upper and lower teeth 510 and 514. Concerning the condition of the number of sheets that are hard to be fastened, the number of sheets can be obtained from a number of prints in a job for example. The smoothness and modulus of rupture of elongation depend on types of the sheets, so that they are derived by employing information stored in advance in the ROM 202 from registered information (information such as plain sheet, recycled sheet, coated sheet, and matte sheet, and medium information) concerning the types of sheets in the image forming apparatus. Concerning the moisture of the sheets, the binding method will be switched depending on information of an environmental sensor provided in the image forming apparatus 900 and on printing modes. That is, it is known that moisture of a sheet is lowered after passing through a fixing apparatus. Therefore, the moisture is lowered further in unitplex printing than that in simplex printing.

While the conditions of the number of sheets, smoothness, modulus of rupture of elongation, moisture have been explained respectively and independently, they are combined in general in an actual use condition. Therefore, a matrix of conditions to be adopted is stored in the ROM 202 in advance, so that it becomes possible to decide the binding mode by selecting at least one condition among these conditions from the matrix corresponding to the printing (fastening) condition of the sheets to be bound.

Figure 14:
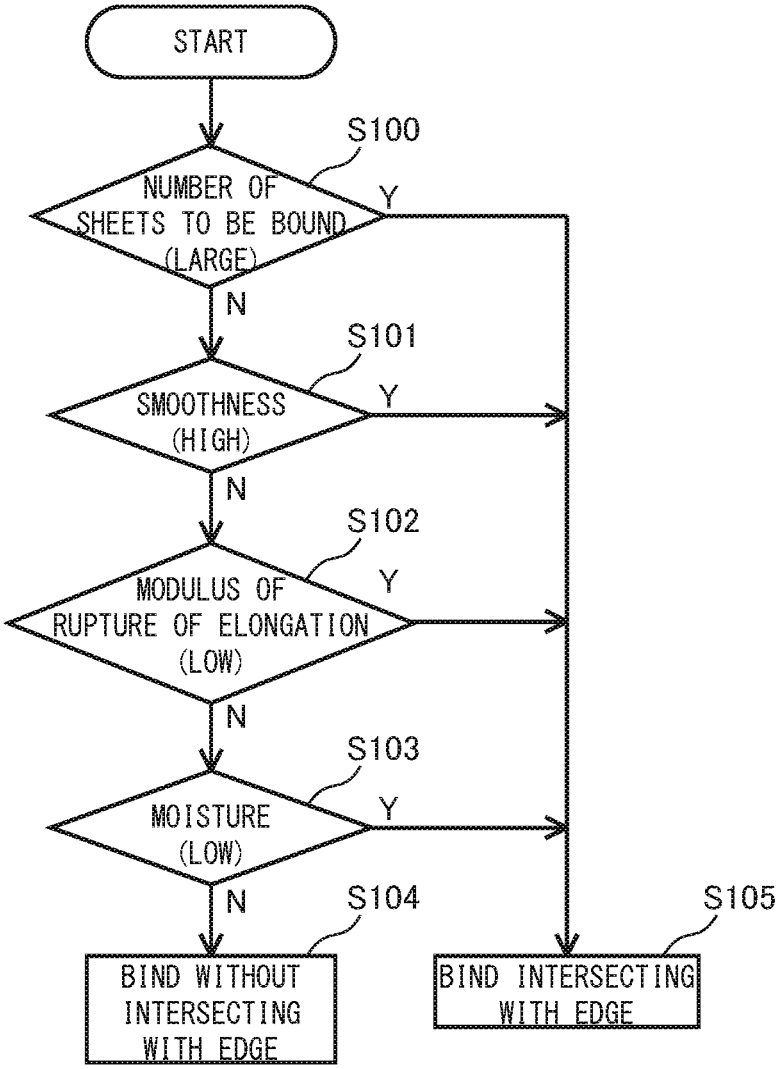
FIG. 14 is a flowchart illustrating controls made in switching the first and second binding modes of the staple-less binding unit.

Next, the control in switching the two modes of the finisher control portion 220 as the control portion (mode switching portion) that switches the two modes of the present embodiment will be explained with reference to FIG. 14. At first, when a job starts, a number of sheets to be bound and information on sheets such as smoothness, modulus of rupture of elongation, and moisture are sent from the CPU circuit portion 200 of the image forming apparatus 900 to the finisher control portion 220.

Before performing the staple-less binding process, the finisher control portion 220 determines whether or not the number of sheets to be bound is greater than a predetermined number of sheets in Step 100. If the number of sheets to be bound is greater than, i.e., more than, the predetermined number of sheets, i.e., Yes in Step 100, the finisher control portion 220 selects the mode of binding the sheets while biting across the edges, i.e., the first mode, in which the bound part includes the edge of the sheet bundle in Step 105. If the number of sheets to be bound is smaller than the predetermined number of sheets, i.e., No in Step 100, the finisher control portion 220 determines whether or not the smoothness is higher than predetermined smoothness in Step 101.

If the smoothness is higher than, i.e., more than, the predetermined smoothness, i.e., Yes in S101, the finisher control portion 220 selects the mode of binding the sheets while biting across the edges in Step 105. If the smoothness is lower than the predetermined smoothness, i.e., No in Step 101, the finisher control portion 220 determines whether or not the modulus of rupture of elongation is lower than a predetermined modulus of rupture of elongation in Step 102. If the modulus of rupture of elongation is lower than, i.e., less than, the predetermined modulus of rupture of elongation i.e., Yes in S102, the finisher control portion 220 selects the mode of binding the sheets by biting the sheets across the edges by the upper and lower teeth in Step 105. If the modulus of rupture of elongation is higher than the predetermined modulus of rupture of elongation, i.e., No in Step 102, the finisher control portion 220 determines whether or not the moisture is lower than predetermined moisture in Step 103.

If the moisture is lower than, i.e., less than, the predetermined moisture, i.e., Yes in S103, the finisher control portion 220 selects the mode of binding the sheets while biting across the edges in Step 105. If the moisture is higher than the predetermined moisture, i.e., No in Step 103, the finisher control portion 220 selects the mode of binding the sheets without biting across any edge, i.e., the second mode, in which the bound part does not contain the edge of the sheet in Step 104. The finisher control portion 220 decides the sheet bundle binding mode through such steps.

That is, the mode is switched to the first mode when at least one condition is met among such conditions that the number of sheets of the sheet bundle is more than the predetermined number of sheets, the smoothness of the sheets is more than the predetermined smoothness, the moisture is less than the predetermined moisture, and the modulus of rupture of elongation is less than the predetermined modulus of rupture of elongation in the present embodiment. In other words, corresponding to such conditions as the surface nature, moisture and others of the sheets, the mode is switched to the simple second mode of moving the sheet bundle to the binding position only by moving the front and rear aligning plates 109 or to the first mode of moving the front and rear aligning plates 109 and the rear edge assist 112. This arrangement makes it possible to assure the predetermined fastening power stably by thus switching to the first mode corresponding to the surface nature, moisture and others of the sheets.

As described above, the mode is switched to one of the first and second modes by the finisher control portion 220 corresponding to the surface nature, moisture and others of the sheets in the present embodiment. That is, this arrangement makes it possible to assure the predetermined fastening power stably regardless of such conditions as the surface nature, moisture and others of the sheets. In other words, it is possible to assure the predetermined fastening power stably regardless of such conditions as the surface nature, moisture and others of the sheets by switching the binding mode to the first mode or the second mode like the present embodiment corresponding to such conditions as the surface nature, moisture and others of the sheets.

Figure 16:
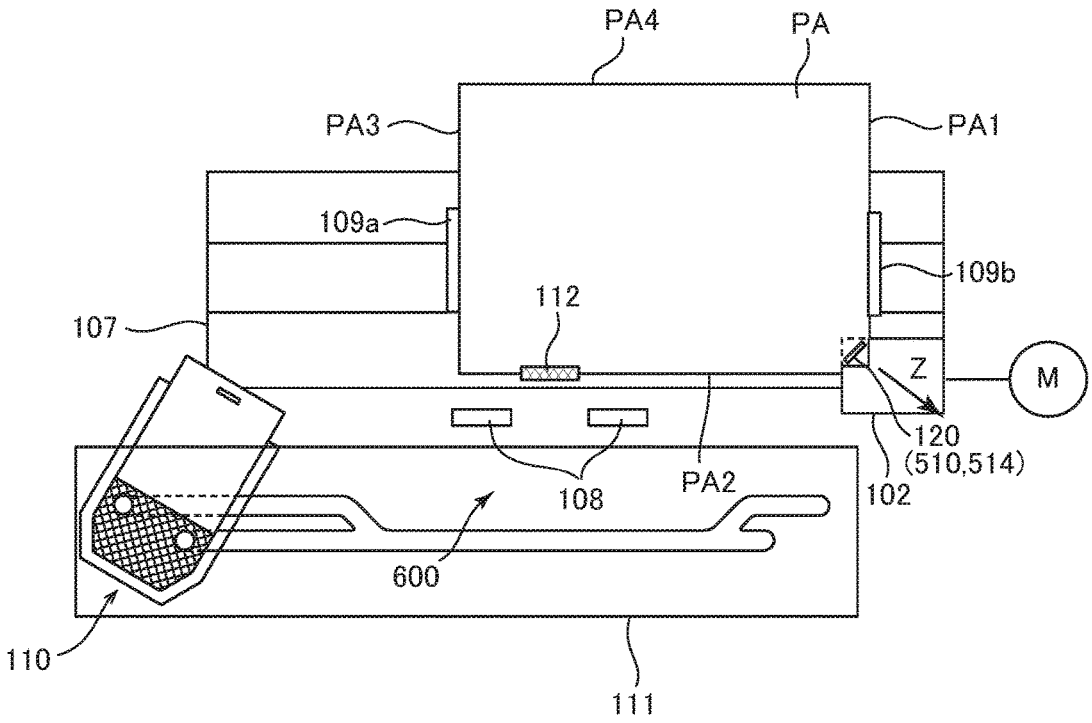
FIG. 16 illustrates an exemplary case of moving the staple-less binding unit.

It is noted that although the moving distance of the sheet bundle is changed in response to the modes switched as described above, the present invention is not limited to that and may be arranged such that the staple-less binding unit is moved in response to the switched mode. For instance, it is possible to select the first mode or the second mode by moving the staple-less binding unit 102 in a direction of an arrow Z as shown in FIG. 16 by a drive portion such as a motor M. This drive portion such as the motor is controlled by the control portion in either of the modes specified by the user.

Figure 15:
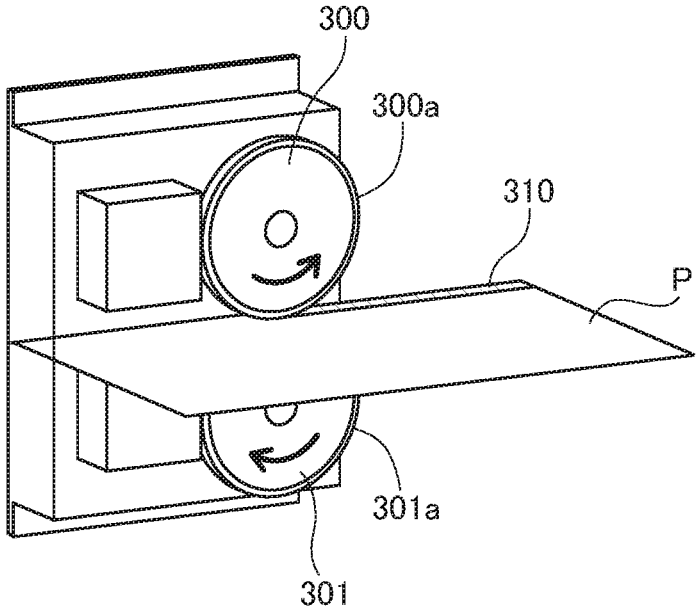
FIG. 15 illustrates a configuration of another binding portion provided in the finisher.

Still further, although the pair of upper and lower teeth 510 and 514 is exemplified as the tooth-like concavo-concave projections composing the binding portion and binding the sheets by forming the plurality of concavo-convex dents that extends in a predetermined direction in the explanation made above, the present invention is not limited to that. For instance, as a unit composing the binding portion, it is also possible to use a unit provided with a pair of rotational members 300 and 301 having concavo-convex teeth 300*a* and 301*a* as first and second binding teeth around outer peripheral portions thereof as shown in FIG. 15. Then, the unit may be configured to perform a binding process by forming a plurality of concavo-convex dents 310 on a bundle of sheets P by rotating the pair of rotational members 300 and 301 while biting the sheet bundle P between the pair of rotational members 300 and 301.

If such pair of rotational members 300 and 301 is adopted, two confronting edges, e.g., PA1 and PA3, of the sheet bundle are bound such that rotational members 300 and 301 bite across the edges in the first mode as shown in FIG. 15. That is, in the first mode, while the edges of the sheet bundle bound by the upper and lower teeth 510 and 514 are the two edges of the sheet bundle neighboring with each other, the edges of the sheet bundle bound by the pair of rotational members 300 and 301 are the two edges confronting with each other.

Still further, while the cases of forming the plurality of concavo-convex dents such that it extends across both of the two neighboring edges, e.g., PA1 and PA2, and the two confronting edges, e.g., PA1 and PA3, have been described in the explanation above, the present invention is not limited to that. For instance, it is possible to bind such that the concavo-convex dents extend across only one edge side, e.g., PA2, to which a force is liable to be applied in turning the bound sheet bundle and to bind so as not to extend across the other edge to which a force is hard to be applied. In this case, while the sheet is hard to be separated in turning in a condition of a sheet bundle, the sheets may be easily separated by separating from the other edge in separating the sheet bundle one by one. Still further, while the first and second binding modes are executed by the finisher control portion 220 as the control portion in the embodiment described above, they may be executed by the control portion 200 of the printer body or by an external computer serving as a control portion.

While the present invention has been described with reference to the exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-269205, filed on Dec. 10, 2012, which is hereby incorporated by reference herein in its entirety.

What is claimed is:

1. A sheet processing apparatus, comprising:

a supporting portion on which sheets are supported;

a binder including a first member with a first surface on which a concave-convex portion is provided and a second member with a second surface on which a concave-convex portion is provided and which is engaged with the first surface, the binder being configured to bind the sheets disposed between the first and second members by crimping the sheets using the first and second surfaces; and a controller configured to execute a plurality of modes including first and second modes, an area of the sheets being deformed by being crimped by the first and second surfaces including an edge of the sheets in a case where the first mode is executed, and an area of the sheets being deformed by being crimped by the first and second surfaces not including an edge of the sheets in a case where the second mode is executed.

2. The sheet processing apparatus according to claim 1, wherein the edge of the sheets deformed by being crimped by the first and second surfaces in the first mode is a first edge, and the area of the sheets being deformed by being crimped by the first and second surfaces in the first mode does not include a second edge neighboring the first edge.

3. The sheet processing apparatus according to claim 1, wherein the edge of the sheets deformed by being crimped by the first and second surfaces in the first mode is a first edge, and the area of the sheets being deformed by being crimped by the first and second surfaces in the first mode includes both the first edge and a second edge neighboring the first edge.

4. The sheet processing apparatus according to claim 1, further comprising a positioner configured to position the sheets supported on the supporting portion by contacting at least one edge of the sheets, wherein the binder is configured to bind the sheets, which is positioned by the positioner, by crimping the sheets using the first and second surfaces, and wherein a relative position between the first surface and the positioner in the first mode is different from that in the second mode.

5. The sheet processing apparatus according to claim 1, further comprising a positioner configured to position the sheets supported on the supporting portion by contacting at least one edge of the sheets, wherein the binder executes a binding operation such that at least one of the first and second surfaces approaches the other of the first and second surfaces and the first and second surfaces crimp the sheets which is positioned by the positioner, and wherein a relative position between the first surface and the positioner in a direction along a surface of the sheets on the supporting portion at a time when the binding operation is executed in the first mode is different from that at a time when the binding operation is executed in the second mode.

6. The sheet processing apparatus according to claim 5, wherein a position of the binder in the direction along the surface of the sheets on the supporting portion at the time when the binding operation is executed in the first mode is different from that at the time when the binding operation is executed in the second mode, and wherein a position of the first member in the direction along the surface of the sheets on the supporting portion at the time when the binding operation is executed in the first mode is same with that at the time when the binding operation is executed in the second mode.

7. The sheet processing apparatus according to claim 5, wherein a position of the binder in the direction along the surface of the sheets on the supporting portion at the time when the binding operation is executed in the first mode is same with that at the time when the binding operation is executed in the second mode, and wherein a position of the first member in the direction along the surface of the sheets on the supporting portion at the time when the binding operation is executed in the first mode is different from that at the time when the binding operation is executed in the second mode.

8. The sheet processing apparatus according to claim 1, further comprising a positioner configured to position the sheets supported on the supporting portion by contacting at least one edge of the sheets, wherein the binder is configured to bind the sheets which is positioned by the positioner by crimping the sheets using the first and second surfaces, and wherein a position of the positioner in the first mode is different from a position of the positioner in the second mode.

9. The sheet processing apparatus according to claim 1, further comprising a positioner configured to position the sheets supported on the supporting portion by contacting at least one edge of the sheets, wherein the binder is configured to bind the sheets which is positioned by the positioner by crimping the sheets using the first and second surfaces, and wherein a position of the first member at a time when the sheets positioned by the positioner is bound in the first mode is different from that in the second mode.

10. The sheet processing apparatus according to claim 5, wherein the positioner includes an aligning member provided to be movable in a width direction and configured to align a widthwise position of the sheets.

11. The sheet processing apparatus according to claim 9, wherein the positioner includes an aligning member provided to be movable in a width direction and configured to align a widthwise position of the sheets.

12. The sheet processing apparatus according to claim 5, further comprising:

a conveyance path through which a sheet is conveyed;

a discharger configured to discharge the sheet conveyed through the conveyance path to the supporting portion; and a mover configured to rotate while contacting with an uppermost sheet of the sheets on the supporting portion and to move the uppermost sheet in a moving direction, wherein the positioner includes a member against which a downstream end, in the moving direction, of the sheet moved by the mover abuts.

13. The sheet processing apparatus according to claim 9, further comprising:

a conveyance path through which a sheet is conveyed;

a discharger configured to discharge the sheet conveyed through the conveyance path to the supporting portion; and a mover configured to rotate while contacting with an upper most sheet of the sheets on the supporting portion and to move the uppermost sheet in a moving direction, wherein the positioner includes a member against which a downstream end, in the moving direction, of the sheet moved by the mover abuts.

14. An image forming apparatus, comprising:

an image forming portion configured to form an image on a sheet;

a supporting portion on which sheets, each of which has an image formed thereon by the image forming portion, are supported;

a binder including a first member with a first surface on which a concave-convex portion is provided and a second member with a second surface on which a concave-convex portion is provided and which is engaged with the first surface, the binder being configured to bind the sheets disposed between the first and second members by crimping the sheets using the first and second surfaces; and a controller configured to execute a plurality of modes including first and second modes, an area of the sheets being deformed by being crimped by the first and second surfaces including an edge of the sheets in a case where the first mode is executed, and an area of the sheets being deformed by being crimped by the first and second surfaces not including an edge of the sheets in a case where the second mode is executed.

15. A sheet processing apparatus, comprising:

a supporting portion on which sheets are supported;

a first member with a first surface on which a concave-convex portion is provided;

a second member with a second surface on which a concave-convex portion is provided; and a positioner configured to position the sheets supported on the supporting portion by contacting at least one edge of the sheets, wherein the first and second surfaces crimp and bind the sheets which are positioned by the positioner and disposed between the first and second members, wherein a relative position between the first surface and the positioner can be set such that an area of the sheets being deformed by being crimped using the first and second surfaces includes an edge of the sheets, and wherein the relative position between the first surface and the positioner can be set such that an area of the sheets being deformed by being crimped using the first and second surfaces does not include the edge of the sheets.

* * * * *